US007774958B2

(12) United States Patent
Carruthers

(10) Patent No.: US 7,774,958 B2
(45) Date of Patent: Aug. 17, 2010

(54) REPLACEABLE SHOE CLEAT

(76) Inventor: Stephen M. Carruthers, 15 Cold Spring Rd., Monroe, CT (US) 06468

( * ) Notice: Subject to any disclaimer, the term of this patent is extended or adjusted under 35 U.S.C. 154(b) by 827 days.

(21) Appl. No.: 11/716,736

(22) Filed: Mar. 12, 2007

(65) Prior Publication Data

US 2008/0222924 A1 Sep. 18, 2008

(51) Int. Cl.
*A43B 5/00* (2006.01)
*A43C 15/02* (2006.01)

(52) U.S. Cl. ..... 36/134; 36/67 D

(58) Field of Classification Search ..... 36/67 R, 36/67 D, 127, 134
See application file for complete search history.

(56) References Cited

U.S. PATENT DOCUMENTS 3,566,489 A * 3/1971 Morley ..... 36/67 D
3,715,817 A * 2/1973 White ..... 36/67 D
5,321,901 A * 6/1994 Kelly ..... 36/134
5,926,980 A * 7/1999 Adam ..... 36/134
5,960,568 A * 10/1999 Bell et al. ..... 36/134
6,006,454 A * 12/1999 Sitzler, Sr. ..... 36/127
6,513,266 B1 * 2/2003 Ijiri ..... 36/134
7,047,675 B2 * 5/2006 Briant et al. ..... 36/134
7,076,894 B2 * 7/2006 Santos et al. ..... 36/134
7,134,226 B2 * 11/2006 Robinson et al. ..... 36/134

* cited by examiner

*Primary Examiner*—Marie Patterson
(74) *Attorney, Agent, or Firm*—Perman & Green, LLP

(57) ABSTRACT

A replaceable shoe cleat is provided having a receptacle element and a detachable cleat element. The receptacle element is adapted to be located within a sole of a shoe. The receptacle element has at least one detent receiving portion. The detachable cleat element is capable of insertion into the receptacle element. The detachable cleat element has a frame with at least one resilient detent portion. The cleat element has a movable lock element coupled with and movable relative to the frame. The resilient detent portion is adapted to enter the at least one detent receiving portion when the cleat element is located in the receptacle element. The movable lock element is movable relative to the frame to lock the at least one resilient detent portion relative to the frame.

21 Claims, 11 Drawing Sheets

REPLACEABLE SHOE CLEAT

FIELD

The exemplary embodiments disclosed relate to a replaceable cleat for shoes and, more particularly, to an interchangeable and readily removable and replaceable cleat for shoes.

BACKGROUND

Removal and replacement of apparatus parts, for example, parts subjected to wear, has been a universal and historically constant concern to apparatus developers and users. A primary characteristic in this regard is what appears, at least at first glance, to be incongruous objectives, that the connection between parts be secure yet allow for ease of removal. Indeed, this primary characteristic extends beyond replacement of apparatus parts, and is incumbent in substantially any connection between two or more parts anticipated to be removed or separated from each other. For example, the desirability of cleats on shoes for enhanced traction has long been recognized, particularly in the endeavors of runners, golfers, football players, mountain climbers, and the like. Cleats are subject to wear. Thus, it is highly desirable that cleats (individually or in groups) be readily removable and replaceable in circumstances where a cleat becomes worn or damaged. Replacement of cleats is also desirable where turf conditions or the turf surface warrant a particular traction design. Removable and replaceable cleats generally have a threaded screw attachment element and a corresponding threaded receptacle is provided in the sole of the athletic shoe. However, threaded cleats often become dislodged, stripped or jammed during use, thus detracting from their initial appeal. Also, for attachment and removal, threaded cleats are generally rotated with a specialized tool, such as a spike wrench. In cases where a cleat becomes worn or damaged, however, a spike wrench may be unable to sufficiently engage the cleat to rotate it and resort must then be had to drills, pliers and the like to forcibly remove the cleat, sometimes damaging the receptacle in the process. Some cleat attachment systems which are not threaded nonetheless require the turn of a spike wrench for attachment and removal and, thus, experience the same disadvantages as threaded cleats. Alternative types of cleat connecting mechanisms have also been developed wherein a latch or knob is biased by a spring. Over time, water, sand and grit can damage the spring such that it cannot properly retract or expand, resulting in the cleat either falling out or becoming so tightly engaged that it can only be removed forcibly.

Therefore, what is needed to overcome the disadvantages of threaded and other detachable cleat systems is to provide for a detachable cleat which may be readily attached to and removed from the sole of a shoe without the use of any special tools and which may also be readily removed even when worn or damaged.

SUMMARY

An object of the disclosed embodiment is to provide a cleat attachment device and method for a detachable and replaceable cleat wherein a cleat may be readily secured to the sole of a shoe without the use of a tool and may be readily removed from the sole of a shoe even when worn or damaged.

A shoe, including a shoe sole having an exterior surface defining one or more openings in the shoe sole, is provided for receiving one or more detachable and replaceable shoe cleats.

In accordance with one exemplary embodiment a replaceable shoe cleat is provided. The cleat has a receptacle element and a detachable cleat element. The receptacle element is adapted to be located within a sole of a shoe. The receptacle element has at least one detent receiving portion. The detachable cleat element is capable of insertion into the receptacle element. The detachable cleat element has a frame with at least one resilient detent portion. The cleat element has a movable lock element coupled with and movable relative to the frame. The resilient detent portion is adapted to enter the at least one detent receiving portion when the cleat element is located in the receptacle element. The movable lock element is movable relative to the frame to lock the at least one resilient detent portion relative to the frame.

In accordance with another exemplary embodiment a replaceable shoe cleat is provided. The shoe cleat has a receptacle element, a detachable cleat element and a manual lock element. The receptacle element is adapted to be located within a sole of a shoe. The receptacle element has a first lock receiving portion formed therein. The detachable cleat element is adapted for insertion into the receptacle element. The detachable cleat element has a first lock portion configured to engage the first lock receiving portion. The first lock portion includes a second lock receiving portion. The manual lock element is adapted for insertion into the detachable cleat element. The manual lock element has a second lock portion for engaging the second lock receiving portion. The manual lock element locks the first lock portion within the first lock receiving portion.

In accordance with another exemplary embodiment a method of attaching a detachable shoe cleat to a shoe is provided. The method comprises inserting a detachable cleat element into a receptacle element so that a first lock portion of the cleat element engages a first lock receiving portion of the receptacle element. The cleat element defines one or more gripping elements thereon for engaging the ground. The method also comprises engaging a second lock receiving portion located on the first lock portion with a second lock portion of a manual locking element so that the first lock portion is locked within the first lock receiving portion.

BRIEF DESCRIPTION OF THE DRAWINGS

The above description and other objects, advantages, and features of the disclosed embodiments will be more fully understood and appreciated by reference to the specification and accompanying drawings, wherein.

DETAILED DESCRIPTION

Figure 1:
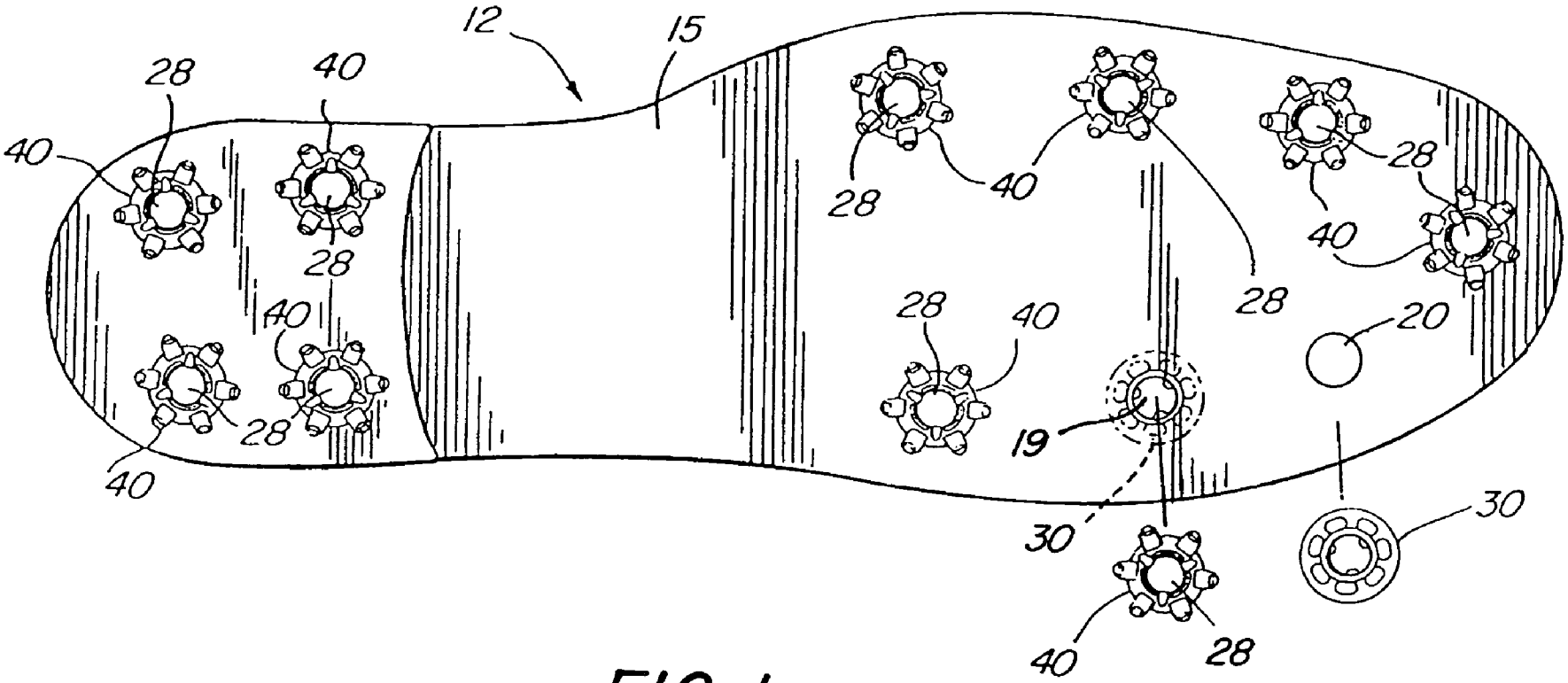
FIG. 1 is a bottom perspective view of a shoe sole according to an embodiment.

Although the embodiments disclosed will be described with reference to the embodiments shown in the drawings, it should be understood that the embodiments disclosed can be embodied in many alternate forms of embodiments. In addition, any suitable size, shape or type of elements or materials could be used. It is also noted that while the described embodiments reference a detachable and replaceable shoe cleat, the embodiments described herein may be applied to attach any two items together.

A detachable and replaceable shoe cleat in accordance with the described embodiments may generally comprise a receptacle element, a detachable cleat element and one or more lock element(s). Although more fully described below, it is noted here that the three components, when properly aligned, share an imaginary central vertical axis extending from a point A to a point B, hereinafter referred to as axis AB, as shown in FIGS. 3, 4, 5, 6 and 7. The descriptions herein assume that the three components are so aligned. The terms "inwardly", "outwardly", "radially" and "axially" are used herein with reference to said axis AB (see FIG. 3). The term "upwardly" references a direction toward an imaginary plane which is perpendicular to axis AB and intersects point A. The term "downwardly" references a direction toward an imaginary plane which is perpendicular to axis AB and intersects point B.

Figure 2:
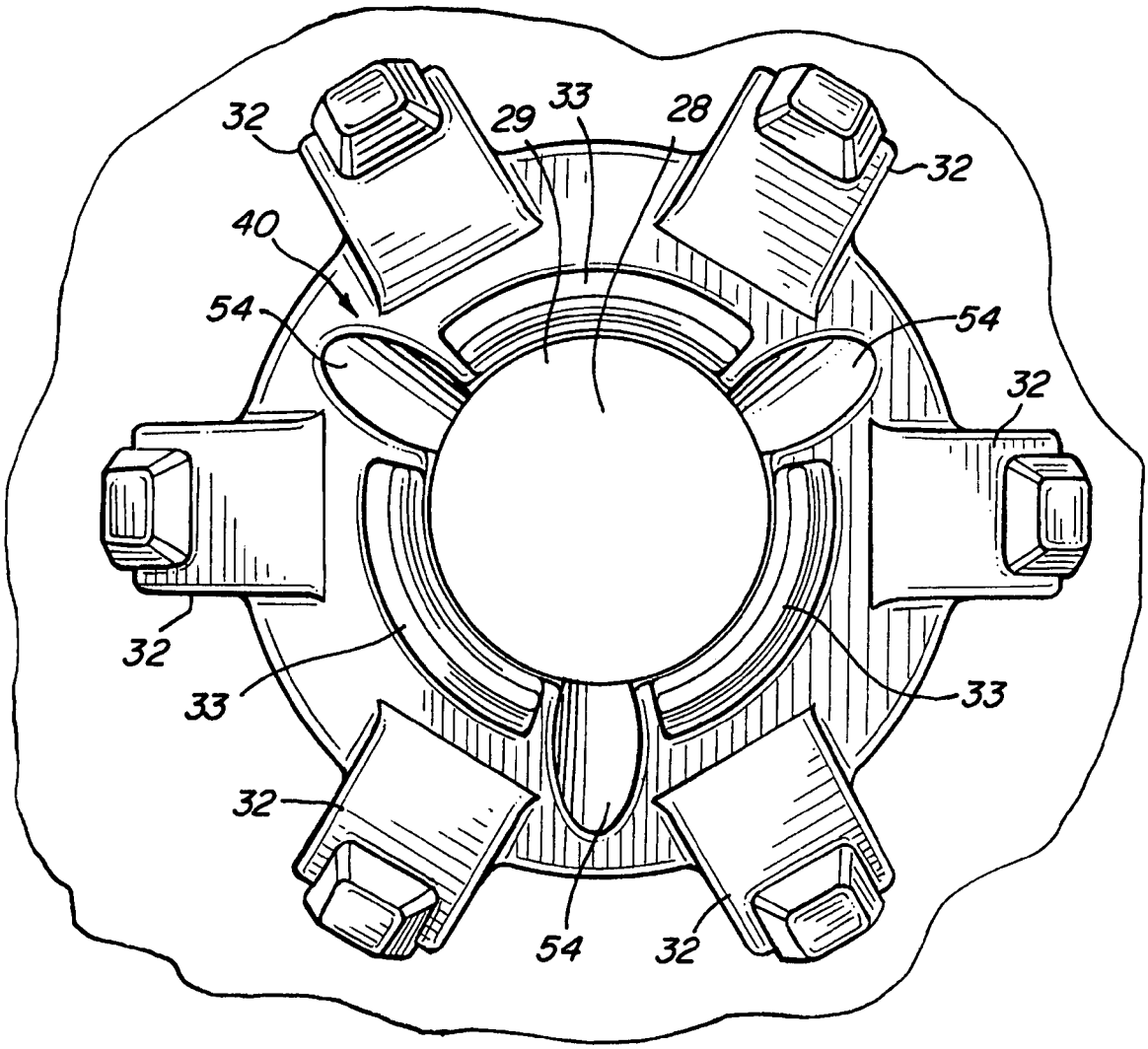
FIG. 2 is a detailed perspective view of the replaceable shoe cleat shown in FIG. 1.

A shoe, including a shoe sole having an exterior surface or sole plate 15 defining one or more openings 20 in the shoe sole 12, is provided for receiving one or more detachable and replaceable shoe cleats. A shoe sole 12 in accordance with the described embodiments is illustrated generally at 12 in FIG. 1. In the embodiment shown in FIG. 1, a receptacle positioned within each opening 20 of the shoe sole 12 defines a cavity 19 for receiving and retaining the combination of a detachable cleat element 40 and a movable lock element, for example securing pin 28. In the embodiment shown in FIGS. 1 and 2, the shoe sole 12 securely houses a receptacle insert 30 disposed within each opening 20 for receiving a combination of a detachable cleat element 40 and a securing pin 28 which combination is detachably secured to the receptacle insert 30.

Figure 3:
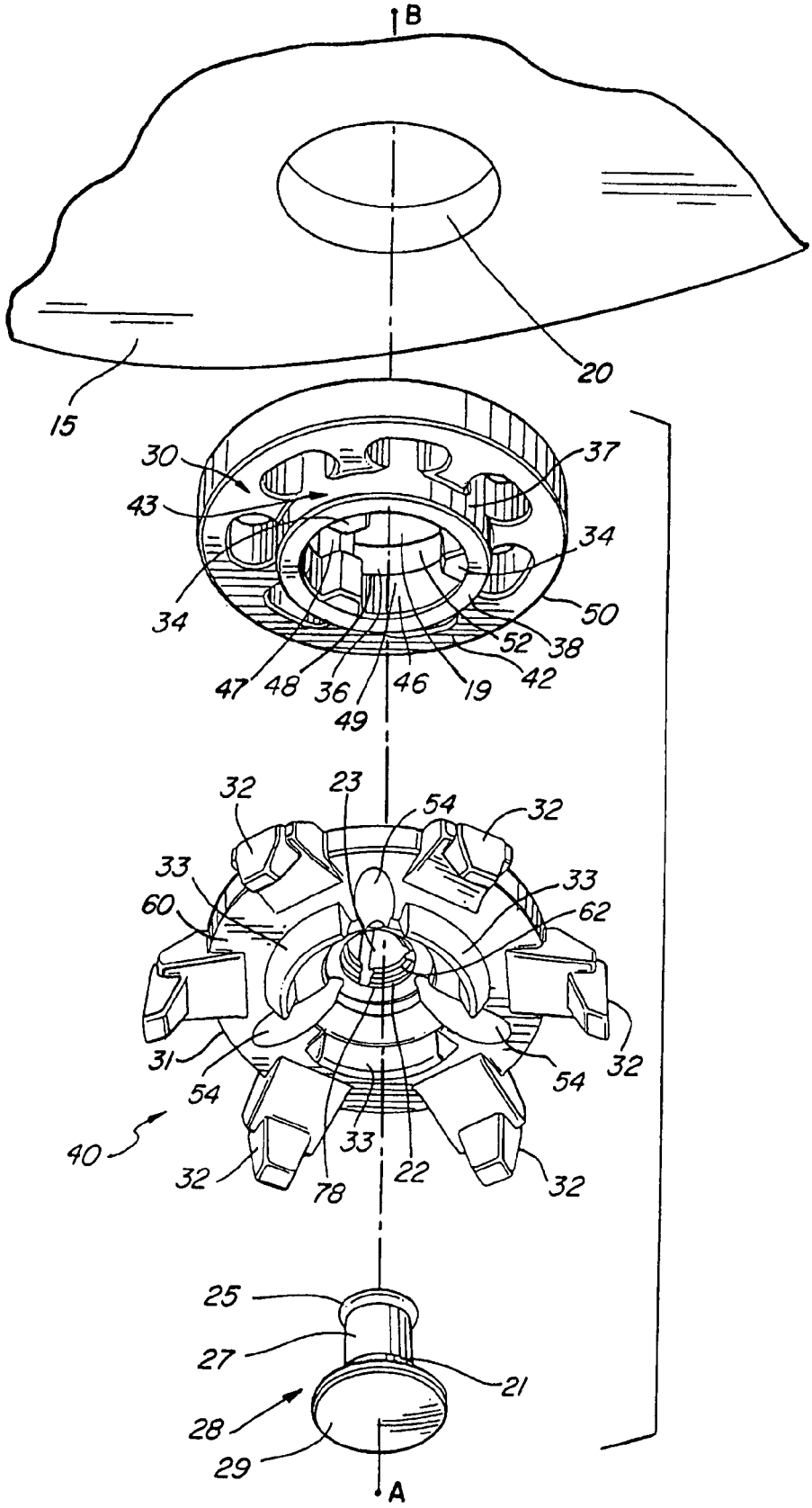
FIG. 3 is an exploded perspective view of the shoe sole, the receptacle insert, the detachable cleat element and securing pin.
Figure 4:
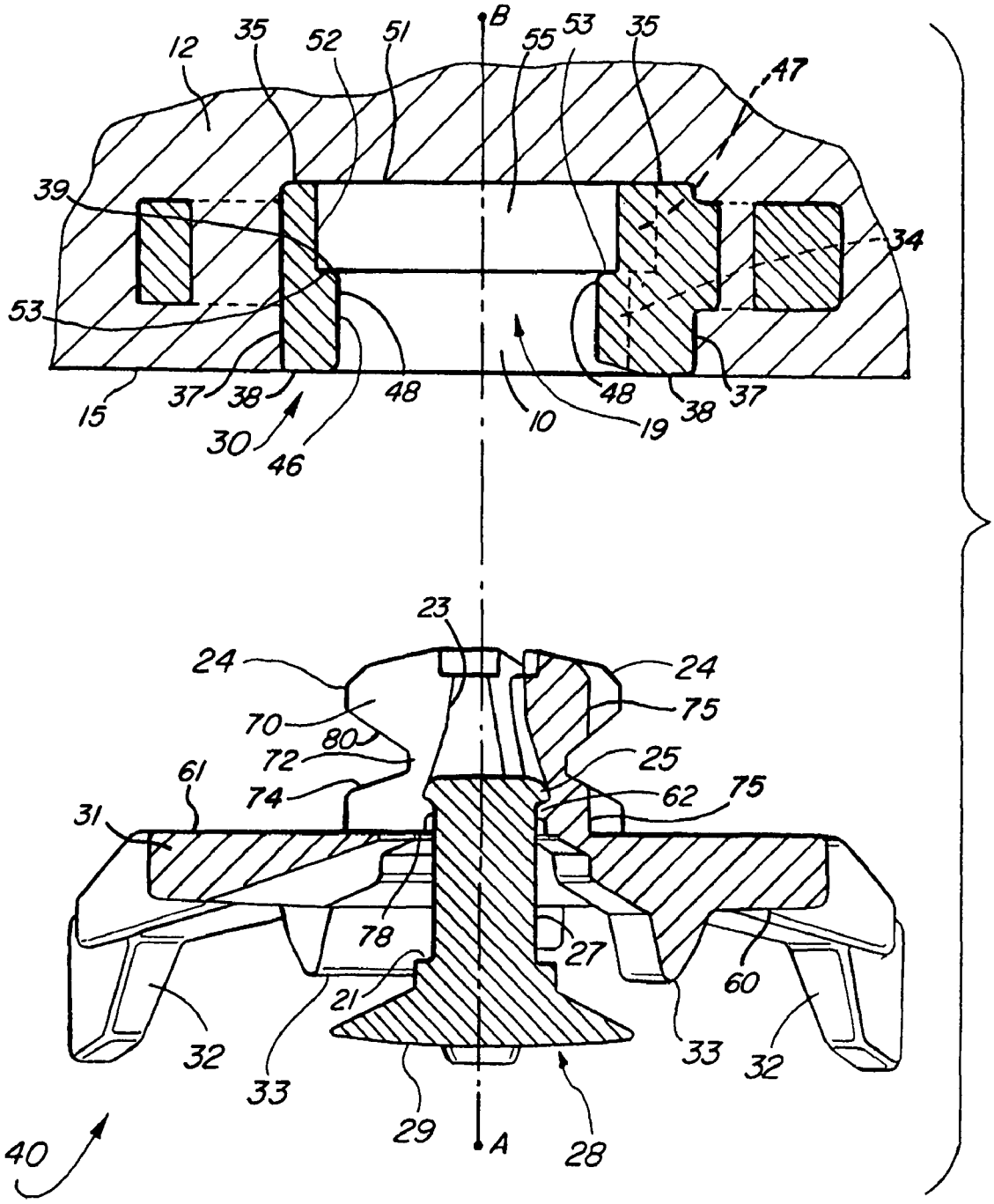
FIG. 4 is a cut away side elevational view of the detachable cleat element with the securing pin ready for insertion into the receptacle insert.

Referring to FIG. 3, there is shown an exploded perspective view of the shoe sole 12 for receiving a replaceable shoe cleat formed by the combination of the receptacle insert 30, the detachable cleat element 40 and the securing pin 28. In the embodiment shown in FIG. 3, the receptacle insert 30 comprises: a receptacle portion 43 defining an open receptacle top 38, an open receptacle bottom 35 (see FIG. 4), one or more exterior sidewalls 37 extending from the receptacle top 38 to the receptacle bottom 35, and one or more interior walls 46, 52 (see FIG. 4) and 53 extending from the receptacle top 38 to the receptacle bottom 35; and an anchoring portion 50 attached to and extending outwardly from the receptacle's exterior sidewalls 37 and formed integral therewith. The anchoring portion 50 has an upper anchoring surface 42 that, when molded into or otherwise securely fixed within the shoe sole 12 during the molding or manufacturing process, positions the receptacle portion 43 such that the receptacle top 38 is generally flush with the sole plate 15 and the receptacle's exterior sidewalls 37 are embedded within the shoe sole 12. As shown in FIG. 4, a material of the shoe sole 12 may enclose the open receptacle bottom 35, for example defining a receptacle floor 51. Thus, in this embodiment, the receptacle which defines the cavity 19 for receiving and retaining a combination of the detachable cleat element 40 and the lock element(s) or securing pin 28 is formed by a combination of the interior walls 46, 52 and 53 of the receptacle insert 30 and a material of the shoe sole 12. In another embodiment, the interior walls and the receptacle floor 51 of the receptacle may be formed entirely by a material of the shoe sole 12. In another embodiment, the receptacle insert 30 positioned at each opening 20 also defines a receptacle floor 51, thereby defining the entire receptacle. Axis AB defines a center of the cavity 19 and extends upwardly through the open receptacle top 38 to point A and downwardly through the receptacle floor 51 to point B.

In the exemplary embodiment shown in FIG. 4, the one or more interior walls of the receptacle insert 30 define a neck 48, thereby dividing the cavity 19 into a receiving opening 10 defined by the interior wall 46 extending from the receptacle top 38 to the neck 48, inclusive, and a retaining chamber or detent receiving portion (shown as having a general configuration) 55 defined by the interior walls 52 and 53. In the exemplary embodiment shown in FIG. 4, the interior walls 46 defining the receiving opening 10 run generally vertically or parallel to axis AB to form a "long" neck 48. In another embodiment, the one or more interior walls 46 defining the receiving opening 10 may generally incline, curve or otherwise pinch inwardly from the receptacle top 38 to form a "short" neck generally along a plane where the receiving opening 10 is conterminous with the retaining chamber or detent receiving portion 55. In the embodiment shown in FIG. 4, the interior walls 53 and 52 of the retaining chamber 55 respectively extend outwardly and downwardly from the neck 48 to the receptacle floor 51. An engagement surface 39 is defined along the outwardly extending interior wall 53. A variety of other embodiments of the receptacle in accordance with the described embodiments are feasible provided such other embodiments comprise a detent receiving portion having an engagement surface. By way of example and without limitation, the interior walls defining the receiving opening 10 could be de minimis, essentially defining a short neck 48 at the receptacle top 38 which opens to the retaining chamber or detent receiving portion 55. Also, the receiving opening 10, the neck 48 and the detent receiving portion (similar to portion 55) could be defined by a single interior wall having a generally hourglass-like shape.

In the embodiment shown in FIG. 3, the upper sidewall 46 defines one or more receive notches 49 having inwardly extending protrusions 34. Similarly, the lower sidewall 52 defines engagement notches 36 also having inwardly extending protrusions 47. As further described below, the inwardly extending protrusions 34 and 47 prevent the detachable cleat element 40 from rotating within the receptacle. In other embodiments, the receptacle can have any noncircular geometric shape corresponding to a similar non-circular shape of engagement projections or resilient detent portions (described below) of the detachable cleat element 40 to prevent the detachable cleat element 40 from rotating within the receptacle. In another embodiment, the upper sidewall 46 and the lower sidewall 52 of the receptacle may be circular and without inwardly extending protrusions, thereby allowing a detachable cleat element 40 to rotate within the receptacle.

Figure 11:
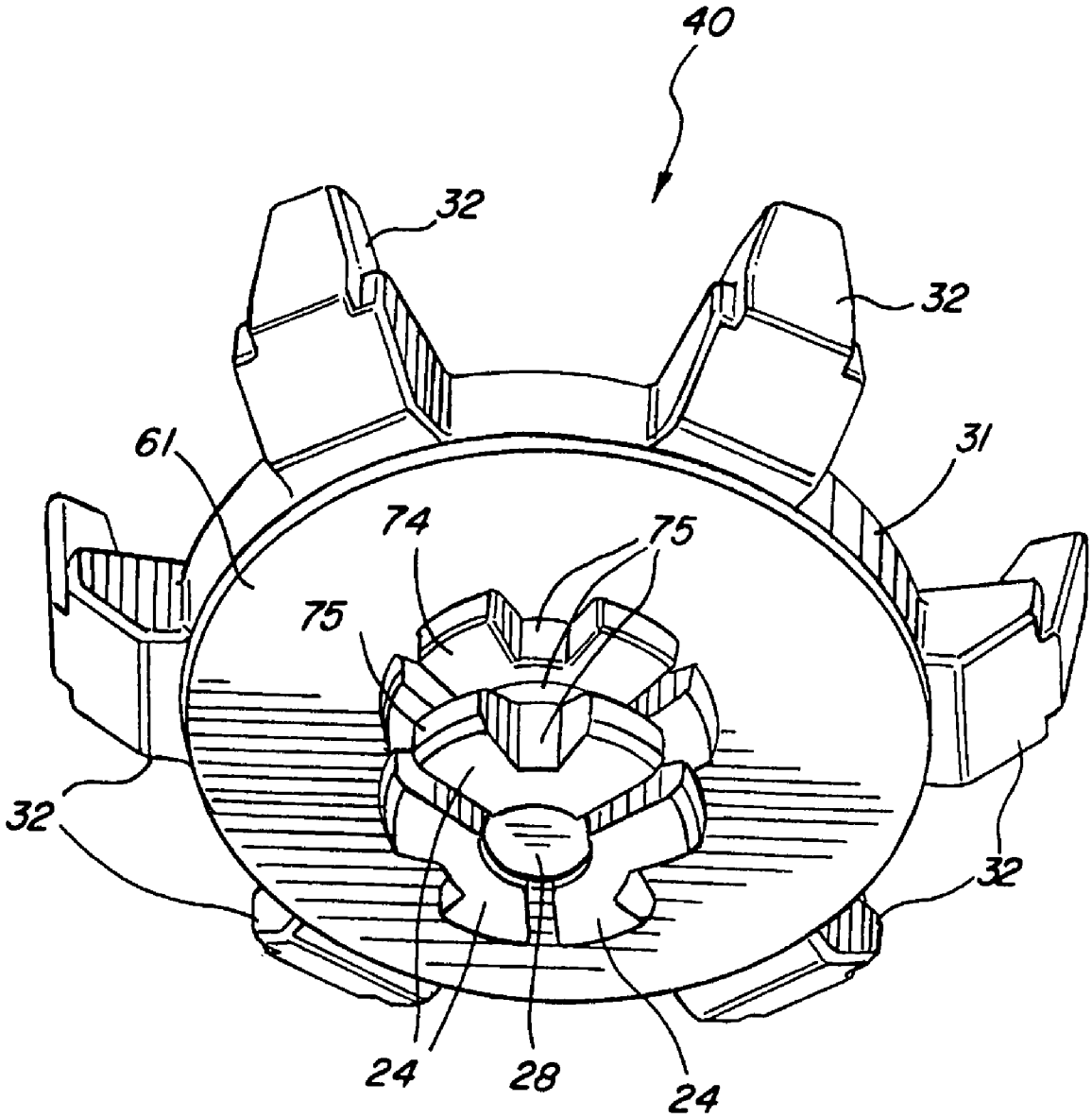
FIG. 11 is a bottom perspective view of the detachable cleat element.

As shown in FIGS. 3, 4 and 11, the detachable cleat element 40 generally defines a frame including a base 31 comprising two oppositely-facing surfaces on a top side 60 and a bottom side 61, said top side 60 being adapted to face away from the shoe sole 12 so as to engage the ground when in use and said bottom side 61 being adapted to face toward the shoe sole 12. The base 31 also defines a base opening 22 extending through the base 31 from said top side 60 to said bottom side 61. Axis AB defines a center of the base opening 22. The top side 60 of the base 31 defines one or more gripping elements, for example spikes 32, for engaging the ground, one or more radially-extending groves 54 and one or more sidewalls 33 located adjacent to and around the base opening 22. Extending from the bottom side 61 of the base 31 are one or more engagement projections or resilient detent portions 24 positioned at the periphery of the base opening 22 and adapted to enter the retaining chamber 55. In the embodiments shown in FIGS. 4, 5, 6, 7, 9 and 11, three engagement projections 24 are provided at the periphery of the base opening 22. In alternate embodiments, there may be more or fewer projections. Each engagement projection 24 is comprised of a resilient "leg" 72 having a proximal end attached to and extending generally downwardly from the bottom side 61 of the base 31 and a distal end comprising a generally outwardly extending detent or foot 70, as shown in the embodiment described in FIG. 4. In alternate embodiments, the detent may be located as desired along the length of the resilient leg 72. Each foot 70 has an upwardly and outwardly facing surface or capture surface 80 extending outwardly and downwardly from the leg 72 such that said capture surface 80 extends from the receiving opening 10 into the retaining chamber 55 when fully inserted into the cavity 19, as more fully described below. The capture surface 80 may either extend outwardly at an angle from the leg 72, as shown in FIG. 4, or along a curve. In the embodiments shown in FIGS. 3 and 4, an annular inwardly-facing surface 23, which also generally inclines inwardly from the base 31 to the foot 70, is defined along each engagement projection 24. As shown in FIG. 7, the engagement projections 24 are sized, shaped and positioned such that the capture surface 80 of each foot 70 is able to extend through the neck 48 of the cavity 19. As shown in FIGS. 6 and 11, the outer walls 75 of the engagement projections 24 are shaped to accommodate any inwardly extending protrusions 34 and 47 of the receiving opening 10 and retaining chamber 55. In the embodiment shown in FIG. 7, the engagement projections also define an upper portion 74 sized to fit generally flush against the interior walls 46 and any inwardly extending protrusions 34 of the receiving opening 10 when the engagement projections 24 are fully inserted into the cavity 19, as more fully described below. In another embodiment, a single engagement projection 24 may be sufficient to detachably secure the detachable cleat element 40 to the receptacle, especially where a substantial upper portion 74 corresponding to a substantial receiving opening 10 is provided to make the detachable cleat element 40 resilient to lateral forces.

In the embodiment shown at FIG. 3, the movable lock element or securing pin 28 is comprised of a generally right circular cylindrical shaft 27, a generally bulging disk-shaped pinhead or head 29 at a proximal end of said shaft 27 and a generally spheroid-like shaped knob portion 25 at the end of the shaft distal to the pinhead 29 wherein the diameter of the shaft 27 is less than the diameter of both the pinhead 29 and the knob 25 so that the securing pin may be coupled to the frame of the detachable cleat element 40 in an unlocked position (as more fully described below) when the two are assembled. It is noted that the pinhead 29 has a greater diameter than the base opening 22 so that it cannot pass downwardly through the base opening 22. The embodiment in FIGS. 3 and 4 also defines a generally right circular cylindrical sealing portion 21 immediately below the pinhead 29 having a diameter greater than the shaft 27 but less than the pinhead 29 to serve as a barrier to dirt and other particles which could potentially interfere with the proper functioning of the securing pin 28. Axis AB runs through a center of the shaft 27 and extends through the pinhead 29 to point A and through the knob 25 to point B. Although not shown, other embodiments of the securing pin 28 could employ a variety of three dimensional shapes, including, without limitation, prisms, non-right circular cylinders, cones and pyramids, such that the pinhead 29, shaft 27, sealing portion 21 and knob 25 of any such other embodiments are proportioned similarly to the corresponding features of the embodiment and such that the transverse width of the pinhead 29 is sufficient to prevent the pinhead 29 from falling through the base opening 22.

The securing pin 28 is coupled to the detachable cleat element 40 in an unlocked or first position prior to insertion of the engagement projections 24 into the cavity 19 of the receptacle. In the embodiment shown in FIGS. 4, 5 and 6, the inwardly-facing surface 23 of each engagement projection 24 defines a raised ridge portion 62 defining an opening for receiving the shaft 27 of the securing pin 28 and sized to prevent the knob 25 of the securing pin 28 from passing upwardly through the raised ridge portion 62, thus coupling the securing pin 28 to the detachable cleat element 40. In another embodiment, no raised ridge portion 62 is defined, but rather the base opening 22 is sized and shaped to receive the shaft 27 of the securing pin 28 and to prevent both the knob 25 and the pinhead 29 from passing through the base opening 22.

As previously discussed, in the embodiment shown in FIG. 3, an annular inwardly-inclining, inwardly-facing surface 23 is defined along the leg portion 72 of each engagement projection 24. As more fully explained below, when the securing pin 28 of the embodiment is inserted through the base opening 22 and coupled to the frame in its locked or second position, a portion of the annular inwardly-facing surface 23 of each engagement projection 24 will lie flush against the surface of the securing pin 28 generally where the shaft 27 meets the knob 25, thus retaining the securing pin 28 in its locked position. Although it is not essential that the shape of the securing pin 28 correspond to the shape of the inwardly-facing surface 23 of each engagement projection 24, such an embodiment creates a greater area of engagement, thereby better retaining the securing pin 28 in its locked position. Thus, for example, where the shaft of a securing pin 28 is prism-shaped, engagement projections 24 having generally planer and inwardly-facing surfaces 23 opposing each side of the prism would most fully engage the securing pin 28 and knob 25. The inwardly-inclining, inwardly-facing surface 23 of the one or more engagement projections 24 also serves to hold the securing pin 28 in an unlocked position such that the securing pin 28 will not interfere with insertion or removal of the detachable cleat element 40 and such that the pinhead 29 extends above the top side 60 of the base 31, as shown in FIGS. 4 and 5.

Figure 5:
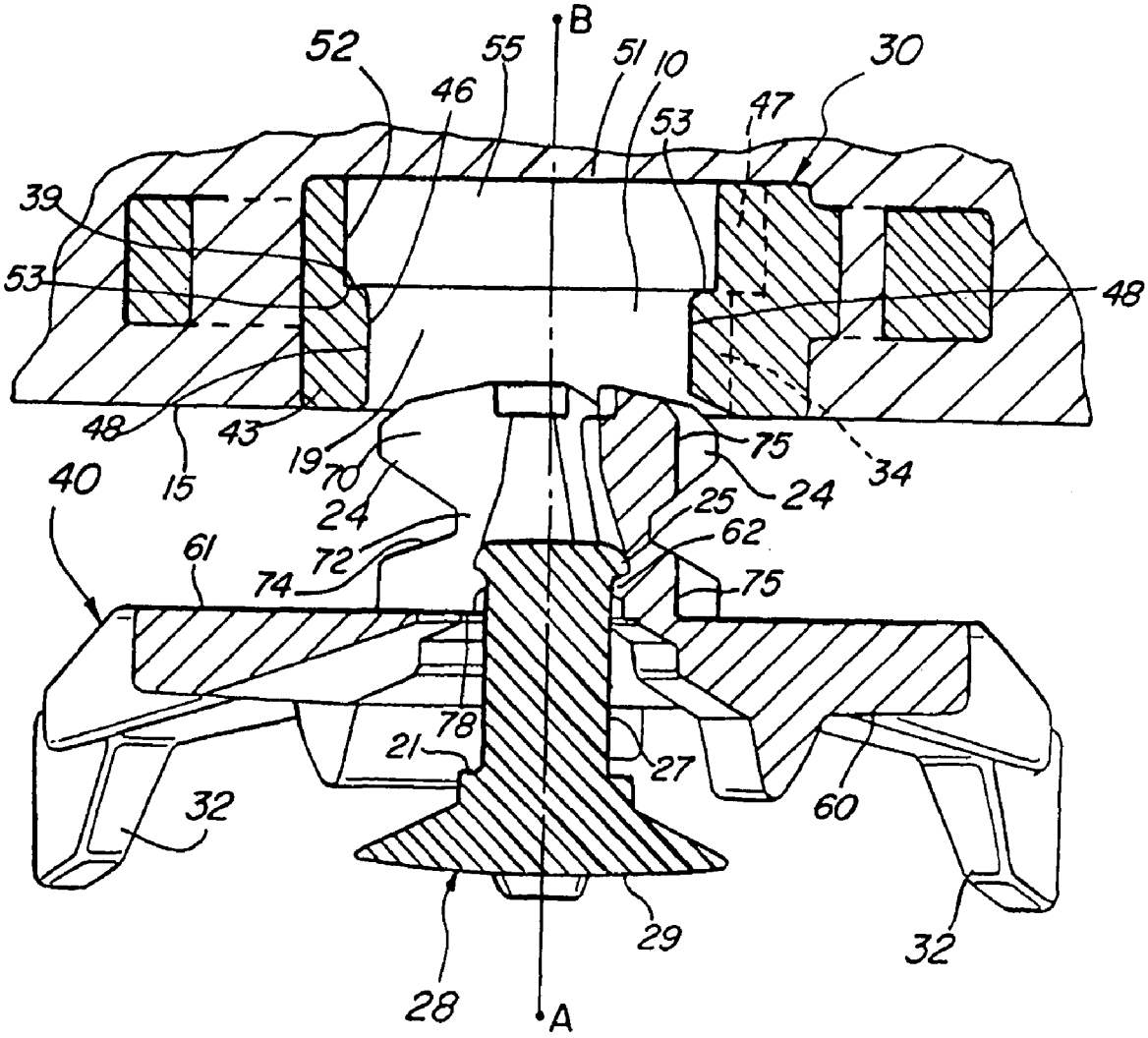
FIG. 5 is a cut away side elevational view of the detachable cleat element with the securing pin beginning its insertion into the receptacle insert.
Figure 6:
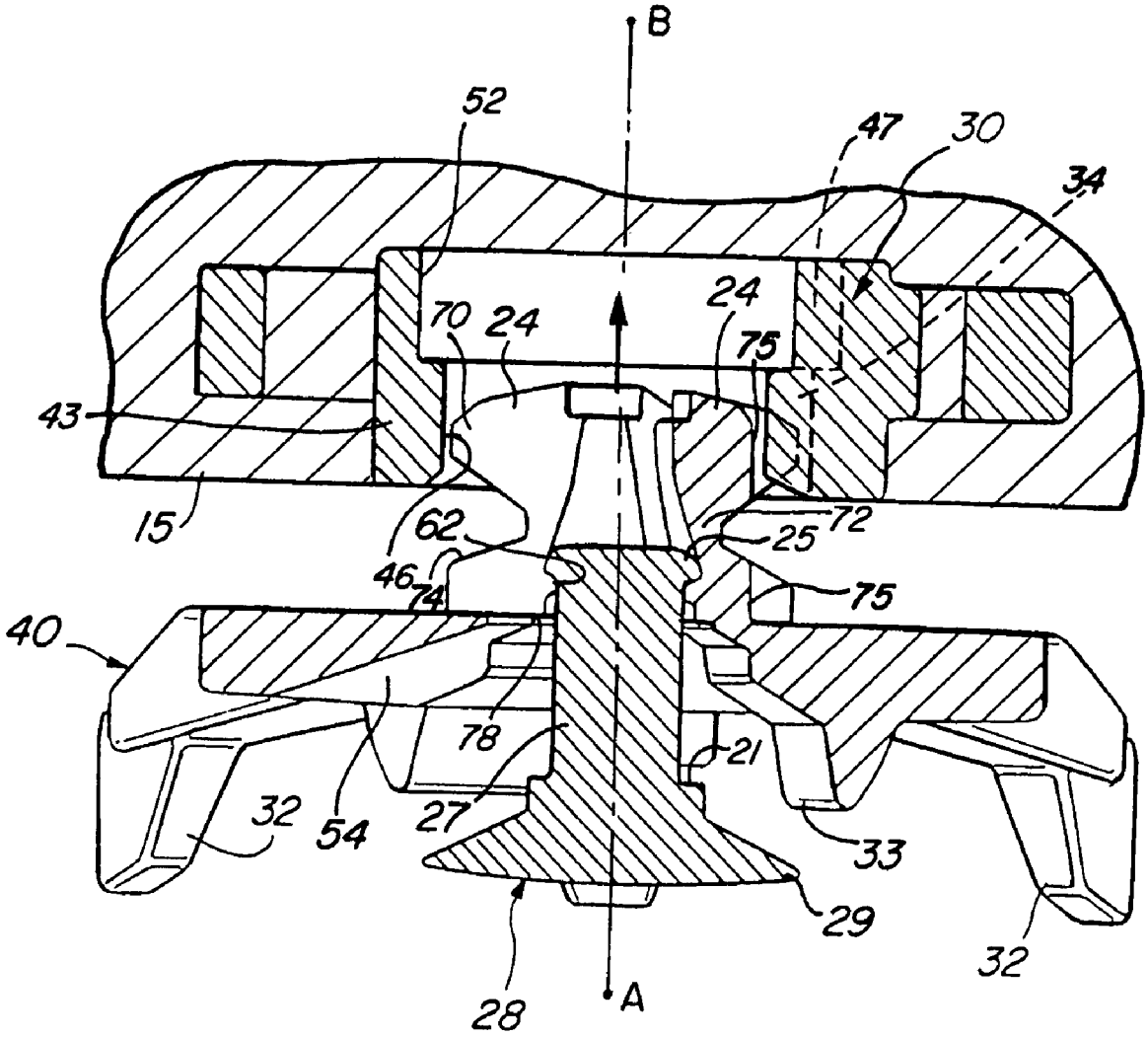
FIG. 6 is a cut away side elevational view of the detachable cleat element with the securing pin halfway through its insertion into the receptacle insert.
Figure 7:
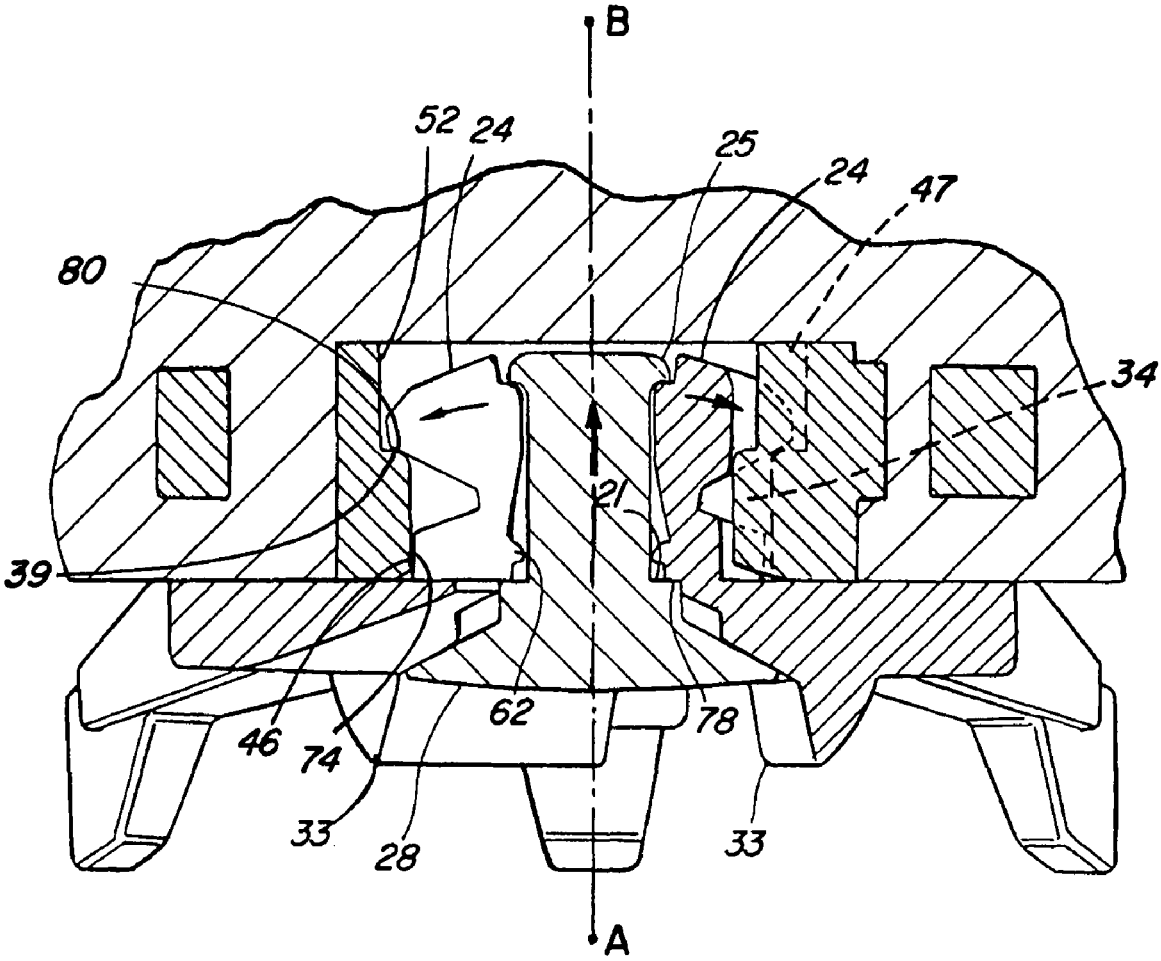
FIG. 7 is a cut away side elevational view of the detachable cleat element with the securing pin completely inserted and in the locked position.
Figure 8:
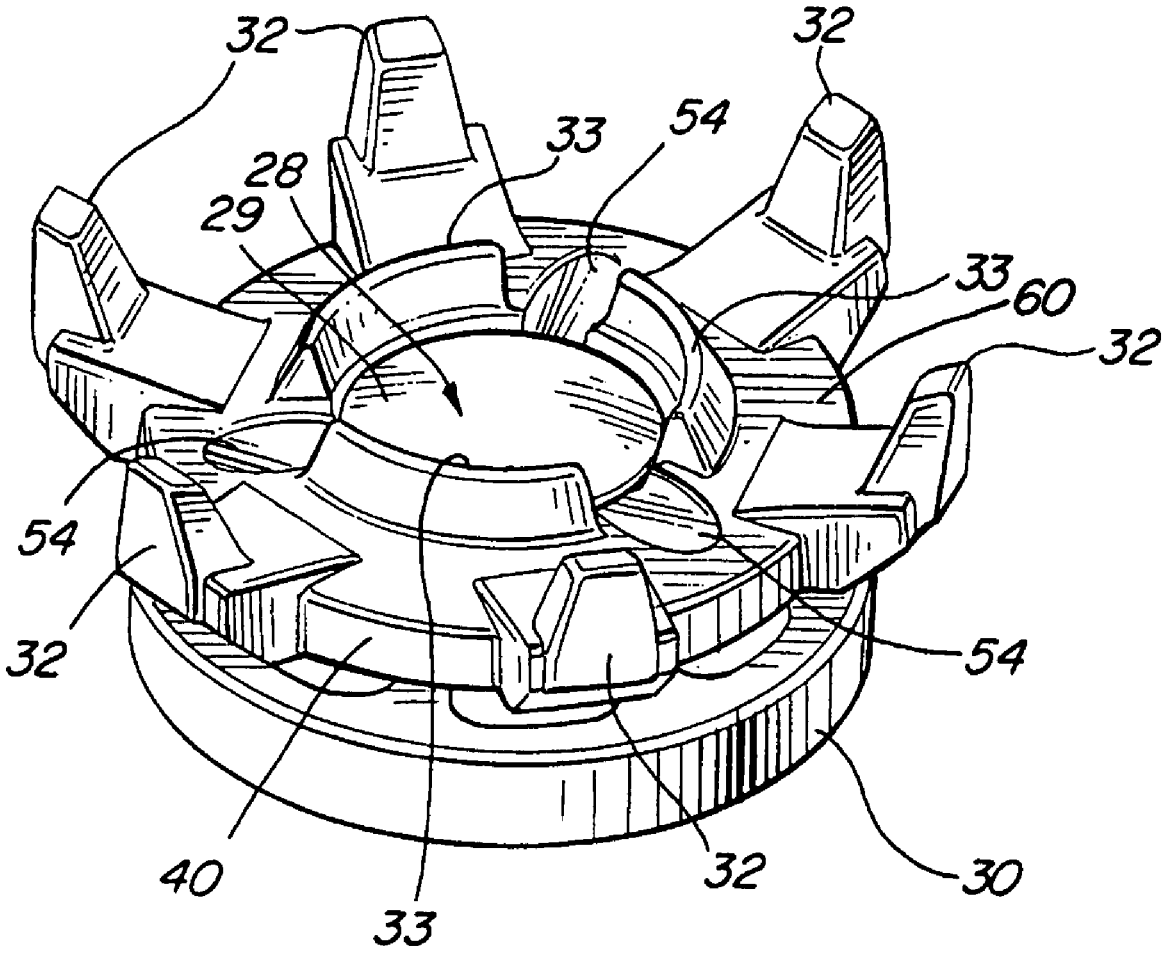
FIG. 8 is a top perspective view of the replaceable shoe cleat with the securing pin in the locked position.
Figure 9:
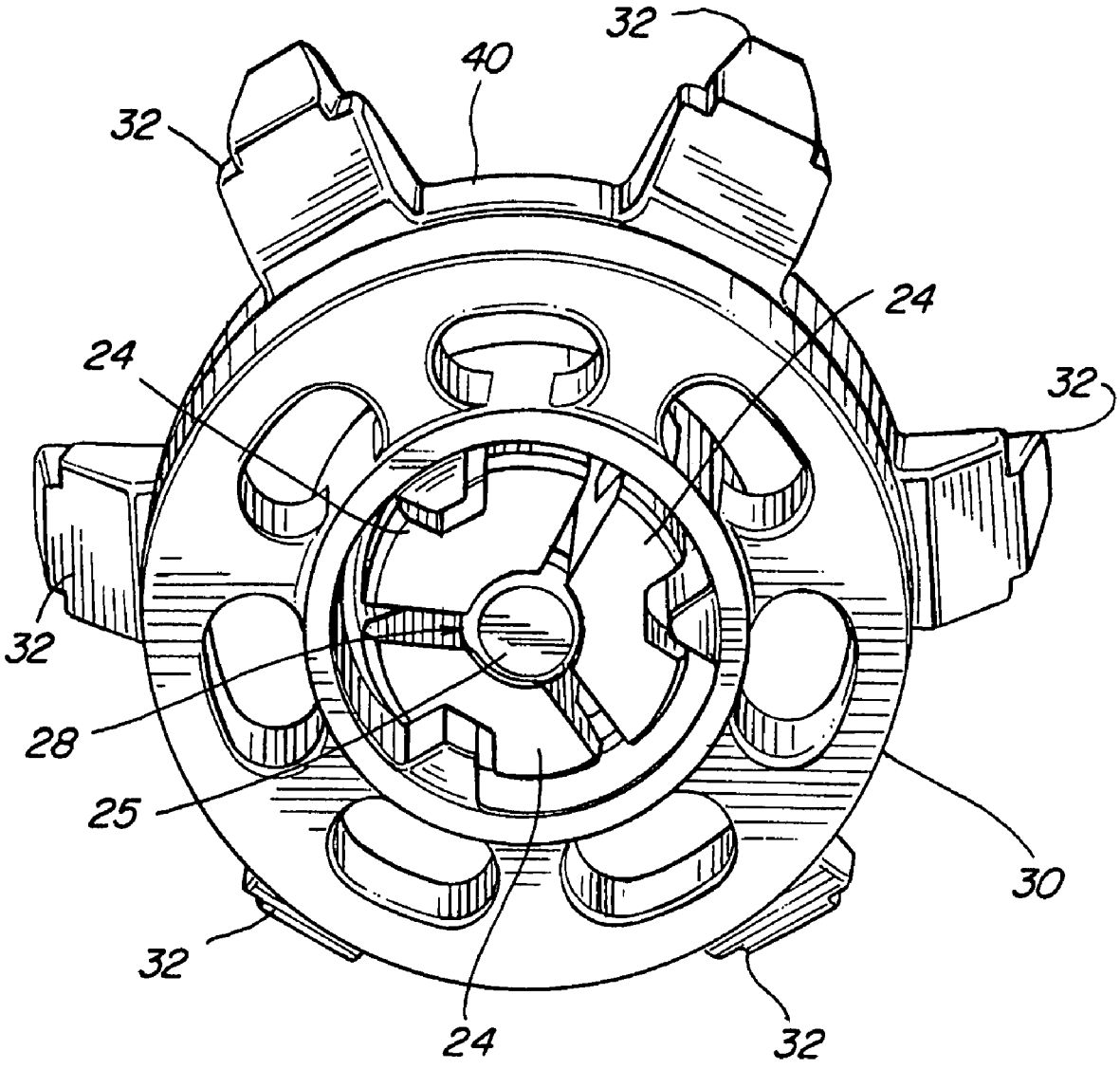
FIG. 9 is bottom perspective view of the replaceable shoe cleat with the securing pin in the locked position.

FIGS. 5 through 7 illustrate the installation process of inserting the detachable cleat element 40 into the cavity 19 and then detachably securing it to the receptacle of the shoe sole 12 using the securing pin 28. The detachable cleat element 40 is first positioned generally coaxially with the receptacle such that the feet 70 of the engagement projections 24 are positioned at the receiving opening 10 and aligned with any receive notches 49, thereby positioning the detachable cleat element 40 for insertion into the receptacle as shown in FIG. 5. Referring to FIG. 6, the detachable cleat element 40 is then pushed or forced axially toward the receptacle floor 51 until the bottom side 61 of the base 31 is generally flush with the sole plate 15 and such that the engagement projections 24 are completely disposed within the cavity 19. In this position, the capture surface 80 of each foot 70 extends into the retaining chamber 55 and the upper portion 74 of each engagement projection 24 is generally flush with the upper sidewall 46 and any inwardly extending protrusions 34. The securing pin 28, which is coupled to the detachable cleat element 40 in an unlocked position as described above, is thereafter manually forced, pushed or otherwise moved axially through the base opening 22 in the frame toward the receptacle floor 51 until the pinhead 29 is generally flush with the top side 60 of the base 31. As the securing pin 28 is so pushed, the knob 25 slides along the inwardly-inclining, inwardly-facing surface 23 of the resilient detent portions or engagement projections 24, thereby outwardly spreading or bending the engagement projections 24 such that the capture surface 80 of each foot 70 of each engagement projection 24 is forced against the engagement surface 39 of the retaining chamber 55 and such that the feet 70 extend into any engagement notches 36. In another embodiment having a single engagement projection, the knob 25 of the securing pin 28 may slide along an interior wall of the receptacle opposite the single engagement projection, thereby outwardly spreading or bending the engagement projection as described above. As the securing pin 28 is further inserted, each engagement projection 24 continues to bend around or compress against the engagement surface 39 allowing the knob 25 of the securing pin 28 to pass through the inwardly-facing surface 23 of each engagement projection 24. When the knob 25 passes completely through the inwardly-facing surface 23 of the engagement projections 24, the distal end of each engagement projection 24 recovers or "springs" back against the securing pin 28 generally where the shaft 27 meets the knob 25, thereby coupling or detachably locking the securing pin 28 to the detachable cleat element 40 in a locked position as shown in FIG. 7. It is noted that a "snap" may be heard and felt by the user when the engagement projections 24 spring back against the securing pin 28 depending on the materials used. When the securing pin 28 detachably locks to the detachable cleat element 40, the capture surface 80 of each foot 70 of each engagement projection 24 remains forced against the engagement surface 39 of the outwardly extending interior wall 53 of the retaining chamber 55. This traps or locks a portion of each foot 70 in the retaining chamber 55 and relative to the frame, thereby detachably securing the detachable cleat element 40 to the receptacle insert 30, as shown in FIGS. 7 and 9. Thus, when the detachable cleat element 40 is secured: the pinhead 29 is generally flush with the top side 60 of the base 31; the bottom side 61 of the base 31 is generally flush with the sole plate 15; the upper portion 74 of each engagement projection 24 is generally flush with the upper sidewall 46 and any inwardly extending protrusions 34 thereby rendering the detachable cleat element 40 resilient to lateral and rotational forces; the securing pin 28 is coupled or detachably locked to the detachable cleat element 40; and the capture surface 80 is held against the engagement surface 39 thereby making the detachable cleat element 40 resilient to any axial forces. The proper orientation is assured since the detachable cleat element 40 can only be inserted when properly aligned. It is noted that for some activities, it may be advantageous to allow the cleat to spin inside the receptacle as a way to help reduce injury. For example, a receptacle 43 having cylindrically shaped interior walls 46 and 52 without protrusions would allow the detachable cleat element 40 to do this. FIGS. 8 and 9 show perspective views of the detachable cleat element 40 secured to the receptacle insert 30.

Although not shown in the accompanying drawings, it is noted that there are a variety of embodiments for a securing pin 28 consistent with the described embodiments having a pinhead 29 and a shaft 27, but no knob 25. For example, a notch could be defined around the circumference of the shaft 27 toward the end distal to the pinhead 29, whereby said notch would capture or snap into a corresponding second raised ridge defined around the inwardly-facing surface 23 of the engagement projections 24 when the securing pin 28 is fully inserted. Conversely, the inwardly-facing surface 23 of the engagement projections 24 could define a notch whereby said notch would capture or snap into a corresponding raised ridge portion defined around the circumference of the shaft 27 toward the end distal to the pinhead 29 when the securing pin 28 is fully inserted (although the raised ridge on the securing pin would function equivalently to the knob described above). Also, the sidewalls 33 on the top side 60 of the base 31 might be shaped and positioned to detachably retain the pinhead 29 of the securing pin 28. Such an embodiment would not require the engagement projections 24 to snap or spring back against the securing pin 28 to detachably lock the securing pin to the detachable cleat element. However, the securing pin 28 of such an embodiment may be more prone to being accidentally dislodged, especially as the sidewalls 33 became worn from use, and thus exemplary embodiments would provide for a locking mechanism within the cavity 19. In addition, with the securing pin 28 fully inserted, it is noted that any upward pulling force exerted on the base 31 of the detachable cleat element 40 would cause the engagement surface 39 to act as a leverage point, causing the feet 70 of the engagement projections 24 to apply additional pressure on the shaft 27 of securing pin 28, thereby helping to ensure that the securing pin 28 remains coupled in its locked position and, therefore, further ensuring that the detachable cleat element 40 remains secure. In another embodiment not shown, the securing pin 28 may be releasably locked to a catch or socket defined on the receptacle rather than to the detachable cleat element 40. However, if the catch or socket were damaged the receptacle could be rendered unusable, and thus exemplary embodiments provide for the securing pin 28 to be coupled to the detachable cleat element 40 when in a locked position. The sidewalls 33 on the top side of the detachable cleat element 40 protect the pinhead 29 after installation from being damaged or broken during use and protect the securing pin 28 from being accidentally removed or dislodged. It is noted that the sidewalls 33 also serve as gripping elements to enhance the traction function of the detachable cleat element 40. Also, as shown in FIG. 7, when the securing pin 28 is fully inserted, the sealing portion 21 is flush with a matching groove portion 78 thereby creating a seal to prevent dirt or other particles from interfering with the proper working of the securing pin 28.

It is noted that in an embodiment not shown, the upwardly and outwardly-facing capture surface 80 of a foot 70 of an engagement projection 24 may be defined only after the securing pin 28 is inserted along the engagement projections 24. For example, each engagement projection 24 may define generally vertical outwardly-facing outer walls 75 and a generally inwardly-inclining, inwardly-facing surface 33. As the securing pin 28 is inserted it would outwardly bend the distal end of each engagement projection 24 more than the proximal end, thereby causing the outwardly-facing outer walls 75 to also face upwardly, thus defining a capture surface 80.

It is noted that the embodiments of the detachable cleat element 40 represented in the drawings are always oriented one way since the detachable cleat element 40 is symmetrical and any engagement projection 24 would fit into any receive notch 49 and any foot 70 would fit into any engagement notch 36. However, for some activities it may be advantageous to orient a non-symmetrical cleat a certain way. Therefore, the receive notches 49 and corresponding engagement projections 24 may be spaced unevenly or otherwise shaped so that the detachable cleat element 40 could only be oriented in one (the proper) way.

As shown in FIG. 6, the feet of the engagement projections 24 are sized and positioned to fit directly through receiving opening 10 of the receptacle 43 to enable the attachment of the detachable cleat element 40 to the receptacle insert 30. However, in an embodiment not shown, the feet of the engagement projections 24 may be sized and positioned with spaces between them as shown in FIG. 9, such that they cannot directly fit through the neck 48, but rather can only fit through the neck by deflecting or pinching inwardly when forced into the receiving opening 10. When this is the case, the capture surface 80 of the foot 70 of each engagement projection 24 may recover or spring outwardly against the engagement surface 39 of the retaining chamber 55 once said feet 70 pass through the neck 48, thereby stabilizing the detachable cleat element 40 within the cavity 19 until the securing pin 28 is inserted to its locked position. Similarly, during removal, the outwardly and downwardly extending capture surface 80 of each foot 70 of each engagement projection 24 would deflect inwardly from the engagement surface 39 when an upward pulling force is exerted on the detachable cleat element 40, thereby allowing the feet 70 of the engagement projections 24 to pass back through the neck 48. This method of removal would also prevail where the one or more engagement projections 24, due to insufficient elasticity, to stress relaxation or otherwise, fail to recover to their original position such that the capture surface 80 and engagement surface 39 continue to oppose one another after unlocking of the securing pin 28. It is noted that the specific position, shape and spacing of engagement notches 46 generally correspond to that of the feet 70 of the engagement projections 24 although it should be understood that the inwardly extending protrusions 47 of the lower sidewall 52 are not essential for the proper functioning of the described embodiments.

Figure 10:
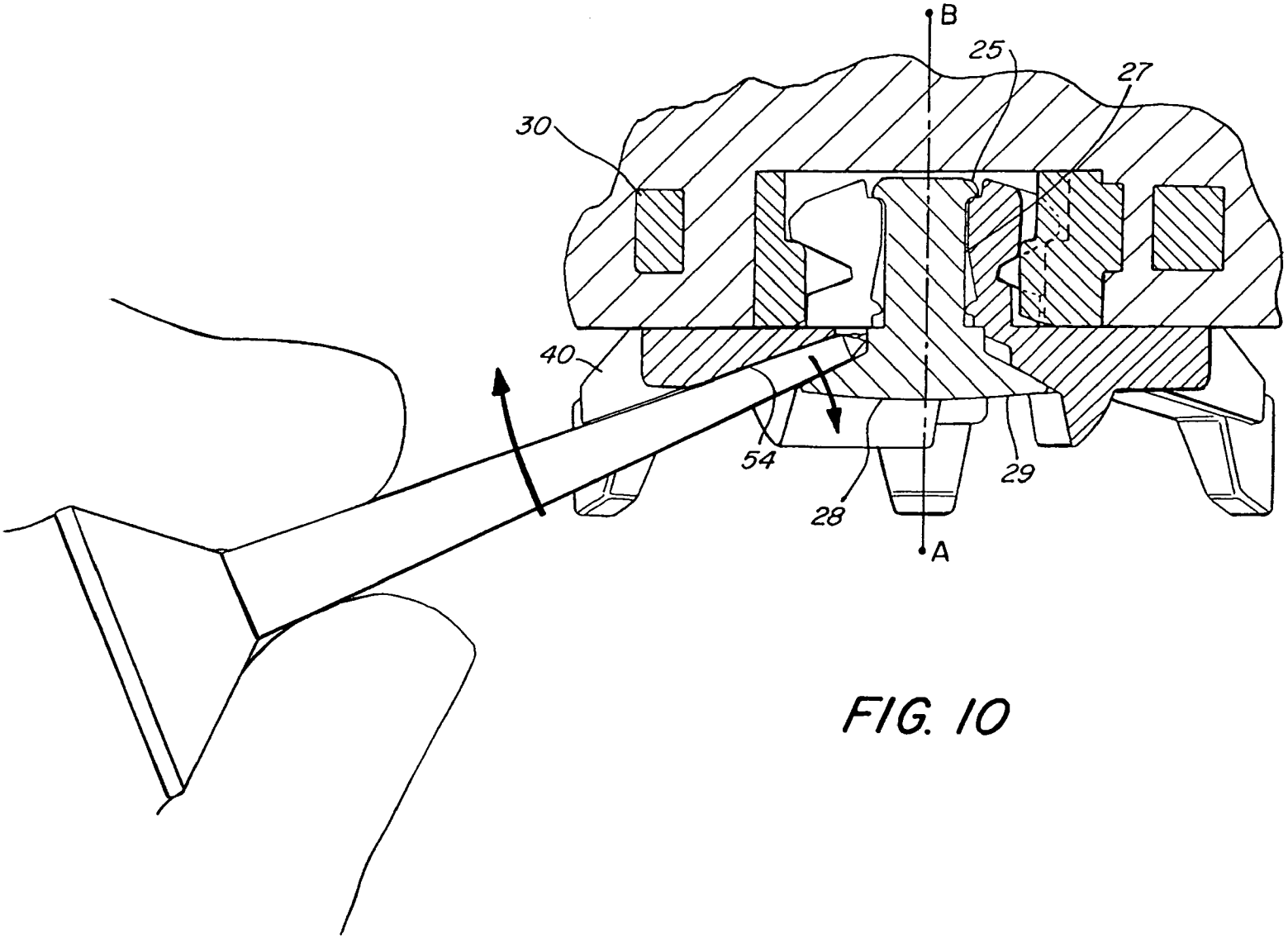
FIG. 10 is a cut away side elevational view of the replaceable shoe cleat with a golf tee placed under the securing pin for separation and removal of the detachable cleat element from the receptacle insert.

Referring to FIG. 10, one or more sidewalls 33 are provided on the top side 60 of the base 31 to protect the pinhead 29 from being damaged and to protect the securing pin 28 from becoming accidentally dislodged. One or more grooves 54 cut in the top side 60 of the base 31 extending radially from the base opening 22 are provided for convenient removal of the detachable cleat element 40 from the shoe sole 12. An end of any tool of proper dimension, such as a golf tee, a ball point pen or a paper clip, may be slid inwardly along the groove 54 to an underside of the pinhead 29 which serves as a lifting surface. With the tool so positioned, the securing pin 28 can be pulled or levered up or otherwise released to its unlocked position, wherein the knob 25 of securing pin 28 first outwardly spreads the feet 70 of the one or more engagement projections 24 out of the way before the engagement projections 24 then recover generally to their positions prior to insertion of the securing pin 28. With the securing pin 28 withdrawn to its unlocked position, the feet 70 of the one or more engagement projections 24 are able to fit back through the neck 48 of the cavity 19, and thus the detachable cleat element 40 is then readily removable from the receptacle 43.

In the embodiment shown in the accompanying drawings, it is noted that a variety of cuts, radiuses, chamfers and tolerances have been incorporated to eliminate any sharp edges and angles where the three components interface with each other and otherwise to facilitate the insertion and removal of the detachable cleat element 40 and the locking and unlocking of the securing pin 28. For example, a user trying to align the engagement projections 24 of the detachable cleat element 40 for insertion into the cavity 19 will feel the detachable cleat element 40 slightly nest or settle into the receiving opening 10 when properly aligned due to the corresponding radiuses defined along the outside edge of the feet 70 and the inside edge of the receptacle top 38.

It is also noted that different gripping elements, arrangements and sizes could also be provided on the top side 60 of the detachable cleat element 40 depending upon the particular activity, i.e., soccer, baseball, football, golf, running, hiking and the like. By way of example, shortened spikes 32 may be defined by a detachable cleat element 40 for playing on synthetic turf or hard natural turf and longer spikes 32 may be defined by a detachable cleat element 40 for playing on soft or wet natural turf. Therefore, a detachable cleat element 40 may thus be interchanged on a shoe sole 12 depending upon the turf surface, turf conditions and the activity for which the article of footwear is utilized. It is also noted that a detachable cleat element 40 without gripping elements may be used as a simple plug allowing a cleated shoe to be used as a street shoe.

The receptacle 43 and the securing pin 28 may be made from hard durable materials including metals and thermoplastics. The detachable cleat element 40 may also be made from a variety of materials provided that the engagement projections 24 are made from a material having sufficient elasticity and flexibility, such as certain elastomers, for the engagement projections 24 to perform as described herein.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims. For example, the interlocking arrangements described before and shown in the figures may be used to removably connect any other desired elements to each other.

What is claimed is:

1. A replaceable shoe cleat comprising:

a receptacle element adapted to be located within a sole of a shoe, the receptacle element having at least one detent receiving portion; and a detachable cleat element for insertion into the receptacle element, the detachable cleat element having a frame with at least one resilient detent portion adapted to enter the at least one detent receiving portion when the cleat element is located in the receptacle element, and having a movable lock element coupled with and movable relative to the frame to lock the at least one resilient detent portion relative to the frame.

2. The replaceable shoe cleat of claim 1, wherein the frame of the detachable cleat element defines a receptacle opening for housing the movable lock element, the lock element having an outer surface substantially flush with an exterior surface of the frame when the lock element is in a lock position.

3. The replaceable shoe cleat of claim 2, wherein the frame has one or more grooves formed therein providing access through the top surface of the cleat element for engagement of a lifting surface of the movable lock element, and wherein lifting the movable lock element effects movement thereof from the locked position to an unlocked position.

4. The replaceable shoe cleat of claim 1, wherein the receptacle element comprises an inner sidewall defining a receiving opening and a cavity below the inner sidewall having a width greater than the receiving opening; and the detachable cleat element comprises a receptacle opening housing the lock element in a first position, the at least one resilient detent portion extending outward from a periphery of the cleat element;

wherein the at least one resilient detent portion and the receptacle opening for housing the locking element are aligned with the receiving opening for insertion of the cleat element.

5. The replaceable shoe cleat of claim 4, wherein the movable lock element is manually movable relative to the frame, the lock element being pushed through the receptacle opening to lock the lock element in a second position, the lock element being configured to detachably secure the cleat element in the receptacle element by trapping the at least one resilient detent portion in the cavity.

6. The replaceable shoe cleat of claim 4, wherein the inner sidewall of the receptacle element is non-cylindrical and defines the receiving opening to correspond in size and shape to the at least one resilient detent portion to prevent rotation of the cleat element within the receptacle element.

7. The replaceable shoe cleat of claim 4, wherein the cleat element defines one or more gripping elements for engaging the ground.

8. The replaceable shoe cleat of claim 4, wherein the lock element has a general pin shape, with a head located exterior to the receptacle opening when the lock element is coupled to the frame, and has another portion distal from the head for engagement of the at least one resilient detent portion.

9. The replaceable shoe cleat of claim 5, wherein the at least one resilient detent portion of the detachable cleat element is inserted into the receptacle element until an engagement section of the at least one resilient detent portion extends into the lower cavity of the receptacle element and an underside of the detachable cleat element is substantially flush with a sole plate of the shoe.

10. The replaceable shoe cleat of claim 9, wherein the lock element is pushed through the receptacle opening to outwardly expand the at least one detent portion into the lower cavity and against an engagement surface of the receptacle element until a protrusion of the lock element passes through the at least one resilient detent portion for detachably securing the detachable cleat element within the receptacle element.

11. The replaceable shoe cleat of claim 9, wherein the lock element is detachably secured within the receptacle opening by the at least one resilient detent portion.

12. A replaceable shoe cleat comprising:

a receptacle element adapted for being located within a sole of a shoe, the receptacle element having a first lock receiving portion formed therein;

a detachable cleat element adapted for insertion into the receptacle element, the detachable cleat element having a first lock portion configured to engage the first lock receiving portion, the first lock portion including a second lock receiving portion; and a manual locking element for insertion into the detachable cleat element, the manual locking element having a second lock portion for engaging the second lock receiving portion;

wherein the manual locking element locks the first lock portion within the first lock receiving portion.

13. The replaceable shoe cleat of claim 12, wherein the first lock portion comprises a resilient leg portion and an engagement portion projecting from the leg portion.

14. The replaceable shoe cleat of claim 13, wherein said detachable cleat element is inserted into the receptacle element such that the first lock portion is located in the receptacle element, the engagement portion of the first lock portion extends into the first lock receiving portion, and an underside of the detachable cleat element is substantially flush with a sole plate of the shoe.

15. The replaceable shoe cleat of claim 13, wherein the manual locking element is pushed through a receptacle opening in the detachable cleat element to outwardly expand the first lock portion into the first lock receiving portion and against an engagement surface of the receptacle element until the second lock portion defined on the manual locking element passes through the first lock portion into the second lock receiving portion thereby detachably securing the detachable cleat element within the receptacle element by trapping the engagement portion of the first lock portion in the first lock receiving portion.

16. The replaceable shoe cleat of claim 15, wherein the manual locking element is detachably secured within the receptacle opening in the detachable cleat element by the first lock portion bias against the manual locking element.

17. The replaceable shoe cleat of claim 13, wherein one or more grooves are provided on a top surface of the cleat element providing an access surface for engagement of a lifting surface of the manual locking element wherein the manual locking element can be levered into an unlocked position allowing the cleat element to be removed from the receptacle element.

18. The replaceable shoe cleat of claim 12, wherein the detachable cleat element defines one or more gripping elements for engaging the ground.

19. A method of attaching a detachable shoe cleat to a shoe comprising:

inserting a detachable cleat element into a receptacle so that a first lock portion of the cleat element engages a first lock receiving portion of the receptacle, the cleat element defining one or more gripping elements thereon for engaging the ground; and engaging a second lock receiving portion located on the first lock portion with a second lock portion of a manual locking element so that the first lock portion is locked within the first lock receiving portion.

20. The method of claim 19, wherein the detachable cleat element is inserted into the receptacle such that an engagement portion of the first lock portion engages the first lock receiving portion and an underside of the detachable cleat element is substantially flush with a sole plate of the shoe.

21. The method of claim 19, wherein the manual locking element is pushed through a receptacle opening in the detachable cleat element to outwardly expand the first lock portion into the first lock receiving portion and against an engagement surface of the receptacle until the second lock portion defined on the manual locking element passes through the first lock portion into the second lock receiving portion thereby detachably securing the detachable cleat element within the receptacle by trapping an engagement portion of the first lock portion in the first lock receiving portion.

* * * * *